US007174640B2

(12) United States Patent
Elkins

(10) Patent No.: US 7,174,640 B2
(45) Date of Patent: Feb. 13, 2007

(54) TOOL FOR CUTTING CABLE TIES LEAVING A ROUND END

(76) Inventor: Bert Vinson Elkins, 10626 Cerveza Dr., Escondido, CA (US) 92026

( * ) Notice: Subject to any disclaimer, the term of this patent is extended or adjusted under 35 U.S.C. 154(b) by 0 days.

(21) Appl. No.: 11/286,851

(22) Filed: Nov. 25, 2005

(65) Prior Publication Data

US 2006/0075642 A1 Apr. 13, 2006

Related U.S. Application Data

(63) Continuation-in-part of application No. 10/705,348, filed on Nov. 10, 2003, now abandoned.

(51) Int. Cl.
*B26B 13/00* (2006.01)
*B26B 9/00* (2006.01)

(52) U.S. Cl. ..... 30/357; 30/279.2; 30/250; 30/258; 30/299; 7/132; 7/134; 81/3.6; 81/9.44

(58) Field of Classification Search ..... 30/178, 30/229, 357, 131, 92, 233, 244, 279.2, 246, 30/250, 172, 173, 230, 253, 254, 249, 258, 30/225, 280, 287, 256; 7/129, 13, 132, 134, 7/158, 106; 140/93.2, 123.6, 123; 81/3.35, 81/3.6, 9.43, 9.44; 29/235, 270, 278
See application file for complete search history.

(56) References Cited

U.S. PATENT DOCUMENTS 267,282 A * 11/1882 Tigniere ..... 606/116
304,089 A * 8/1884 Entrekin ..... 7/134
489,406 A * 1/1893 Austin ..... 30/230
533,527 A * 2/1895 Carmody ..... 30/229
639,869 A * 12/1899 Smith ..... 606/175
787,348 A * 4/1905 Hansen ..... 606/116
1,677,684 A * 7/1928 Parsons ..... 30/229
1,812,484 A * 6/1931 Howe ..... 30/131
1,924,837 A * 8/1933 Crause ..... 7/109
1,938,666 A * 12/1933 Novy et al. ..... 30/229
2,103,597 A * 12/1937 Ravenscroft ..... 30/90.2
2,364,801 A * 12/1944 Martines ..... 30/90.2
2,557,305 A * 6/1951 Morey ..... 81/3.6
2,590,024 A * 3/1952 Lieberman ..... 76/106.5
2,753,741 A * 7/1956 Riley ..... 72/409.13
3,168,119 A * 2/1965 Schwester et al. ..... 140/123.6
3,169,315 A * 2/1965 Mankovitz ..... 30/90.6
3,221,576 A * 12/1965 Goetz ..... 81/9.43
3,731,561 A * 5/1973 Mongredien ..... 81/9.42
3,810,307 A * 5/1974 Mongredien ..... 30/90.1
3,854,202 A * 12/1974 Cortese et al. ..... 30/91.2
3,914,864 A * 10/1975 Prince ..... 30/90.6
4,208,749 A * 6/1980 Hermann et al. ..... 7/106
4,226,145 A * 10/1980 Gill ..... 30/90.1
4,271,838 A * 6/1981 Lasner et al. ..... 606/138

(Continued)

*Primary Examiner*—Boyer D. Ashley
*Assistant Examiner*—Ghassem Alie
(74) *Attorney, Agent, or Firm*—Dean Edmundson

(57) ABSTRACT

The present invention presents a pliers-like hand tool with special shaped cutting edges and grooved guides in the jaws of the tool so that when used to cut off the unwanted ends of cable ties the cable tie can be guided into the tool and positioned for cuffing the end of the cable tie leaving a smooth rounded end on the cable tie.

2 Claims, 3 Drawing Sheets

U.S. PATENT DOCUMENTS 4,283,933 A * 8/1981 Wiener ..... 72/409.12
4,447,949 A * 5/1984 Kane ..... 30/90.6
4,637,084 A * 1/1987 Wood ..... 7/134
4,796,318 A * 1/1989 Bigej ..... 7/106
5,062,192 A * 11/1991 Sawyer et al. ..... 29/426.4
5,235,750 A * 8/1993 Brown ..... 30/135
5,254,129 A * 10/1993 Alexander ..... 606/170
5,372,166 A * 12/1994 Lai ..... 140/123.6
6,502,310 B1 * 1/2003 Shaw ..... 30/90.4

* cited by examiner

TOOL FOR CUTTING CABLE TIES LEAVING A ROUND END

CROSS REFERENCE TO RELATED APPLICATIONS

This application is a CIP of my earlier application Ser. No. 10/705,348 filed on Nov. 10, 2003 now abandoned.

FEDERALLY SPONSORED RESEARCH AND DEVELOPMENT

No federally sponsored research and development.

REFERENCE TO "MICROFICHE APPENDIX"

No microfiche.

BACKGROUND OF INVENTION

1. Field of Invention

This invention relates to a plier type tool for cutting excess material off of cable ties and leaving a smooth round cut across the cable tie.

2. Background of Invention

Plastic straps or bands with a self locking head on one end and ridges across the strap on one side that are designed to form a locked tie loop when the free end of the strap is threaded through the self locking head on the other end of the strap are known in the industry as Cable Ties and sometimes referred to as Wire Ties. Cable ties are use to secure many things such as holding a number of electrical wires together in a bundle or securing wires or a cable to a beam or wall, and are being used in more and more applications as time goes on. When a cable tie is used there is an unwanted length of tie extending beyond the tie locking head. To remove this unwanted length of cable tie the present art is to use a knife, scissors, nippers or shears to cut off the unwanted length of tie. All of these tools make a square cut on the end of the tie thereby leaving sharp edges on the corners of the cut end of the tie. These sharp edges can cause pain by pricking and cutting the skin of the person making contact with them, thereby providing a source of infection. Since cable ties are often used in tight confined spaces such as under the hood of automobiles, in motor hatches and between bulkheads on boats, wings and fuselage of airplanes, and the like, being pricked by these sharp edges is often unavoidable. What is needed is a tool that will cut off the unwanted length of the tie leaving a smooth rounded end on the tie. The tool must be an efficient cutting device that can be effectively used in confined spaces. The tool of this invention is shown on the drawings as FIGS. 1 through 6 and can be used effectively in tight confined spaces because it can cut the cable tie from one or more directions and provides a means for guiding the tie into the tool and securing the tie in the proper location for making the desired round cut across the tie.

3. Description of Related Art

Presently to cut off the unwanted length of tie a knife, scissors, nippers, or shears are used. Each of these tools make a straight cut across the end of the tie leaving sharp corners on the edge of the cut. There are a few tools that were designed and patented to perform task that are totally un related to cutting cable ties but conceivably can make a round cut on a cable tie, however, to try to use these tools for cutting a round end on a cable tie would be inefficient, clumsy, and in tight confined spaces difficult or impossible to use. In all cases more than one tool would be needed to cut cable ties from the front and both sides of the tool. There are special tools that have been patented that will grip the tie and pull it tight around the bundle of wires, cables, etc and cut the unwanted portion of the tie off next to the self locking head, but all of these special toots make a straight cut across the tie leaving sharp corners on the end of the cut tie.

Tull {U.S. Pat. No. 422,666 patented Mar. 4, 1890} invented a harness-tool for cutting slots in straps for the insertion of the tongues of buckles. To accomplish this task Tull designed a cutting edge that when bolted to one jaw of a plier type tool would cut a slot in a strap when the cutting edge was pressed against the other jaw of the plier type tool. Tull's tool will only cut a cable tie with the desired round end when the tie is inserted from the right side. It will not make the desired cut when the tie needs to be cut from the left side or through the nose of the tool. Tull's tool does not provide a guide for the proper placement of the tie in relation to the cutting edge to insure a smooth round cut across the tie.

Osborne et al (U.S. Pat. No. 2,624,940 patented Jan. 13, 1953) designed a tool to punch notches in computer cards. The design provides a receptacle below the punch to hold the punched peaces of card. A bottom plate is secured to the bottom of the receptacle by screws. It is conceivable that by removing the bottom plate a cable tie can be inserted through the nose of the tool and out the bottom and cut off by the punch, however the cut would leave a notch in the end of the tie inserted of a round end. In order to make a round cut on the end of the tie the tie would have to be inserted from the rear of the tool and out the nose. This would be an extremely clumsy method of cutting a cable tie and since the tie is securing a bundle of wires or the like the bundle of wires would prevent the tie from being cut next to the locking head. The tool also has the disadvantage of not being able to cut a tie from both sides. Also, the tool does not provide guides for positioning the tie.

Sylvester {U.S. Pat. No. 813,598 patented Feb. 27, 1906} designed cutting-nippers with circular cutting-bits for cutting wire, nails, rods, rivets, or bolts. The tool is designed with two pivot points in order to provide the cutting power necessary to cut thick wire, nails, and the like. Cable ties are made of plastic and can easily be cut with a tool having only one pivot point. Two pivot points make for unnecessary expense and a bulky tool. Using this tool to cut cable ties in the same manner that it would be used to cut nails, wire, etc would leave a convex cut on the end of the tie with sharper edges on the corners of the cut than would be left with a straight cut across the tie. To make a round cut on the end of the tie it would require the tie to be inserted from the side and angled to the rear of the tool. This would be a very clumsy and undesirable way to cut a cable tie. Sylvester's tool also does not provide a means of guiding the tie into the cutting edges to insure the desired round cut across the tie Filan, U.S. Pat. No. 1,893,737. and Petersen, U.S. Pat. No. 2,590.031 were evaluated but are considered irrelevant since the tools of both patents would make a straight cut across the cable tie. In addition the tools are bulky and would be difficult if not impossible to use in confined spaces. Also the tools do not provide a means to guide and secure the tie in the proper position for cutting.

BRIEF SUMMARY OF INVENTION

The present invention provides a hand tool that is constructed like pliers and provides cutting edges in the jaws of the tools for cutting off the excess length of cable ties leaving a smooth rounded cut on the end of the tie, and provides guides in the jaws to insure that the ties are positioned so they are perpendicular to the cutting edges thereby insuring the desired round cut on the end of the tie. The smooth rounded cut on the end of the tie eliminates the sharp corners resulting from making a straight cut across the tie when existing tools are used to cut off the excess length of tie. To use the tool the operator simply inserts the tie through the guide in the nose of the tool or through the guide for cutting the tie from either side of the tool, slides the tool along the tie until it butts up against the locking head and then squeezes the handles forcing the cutting edges to cut the tie.

To date the most common practice is to use straight edge wire cutters, generally referred to as dikes, to cut the excess length of tie off leaving a square cut with sharp corners. The present invention uses a similar pair of pliers incorporating curved cutting edges in the jaws of the pliers instead of the straight edge cutters. Also incorporated in the jaws of the tool are guides in the form of slots through the jaws that position the ties perpendicular to the cutting edges thereby insuring the desired round cut across the tie. When the jaws of the pliers are opened and the free end of the tie is inserted into the tool through the guides and between the cutting edges the unwanted length of the tie can be cut off by squeezing the handles of the tool together thereby forcing the cutting edges to cut the tie leaving a smooth rounded cut on the end of the tie. FIGS. 1 through 6 illustrates this tool in the drawings.

DESCRIPTION OF DRAWINGS

The drawings illustrate the present invention.

FIG. 1 is an isometric view of the tool.

DESCRIPTION OF THE PREFERRED EMBODIMENT

Figure 1:
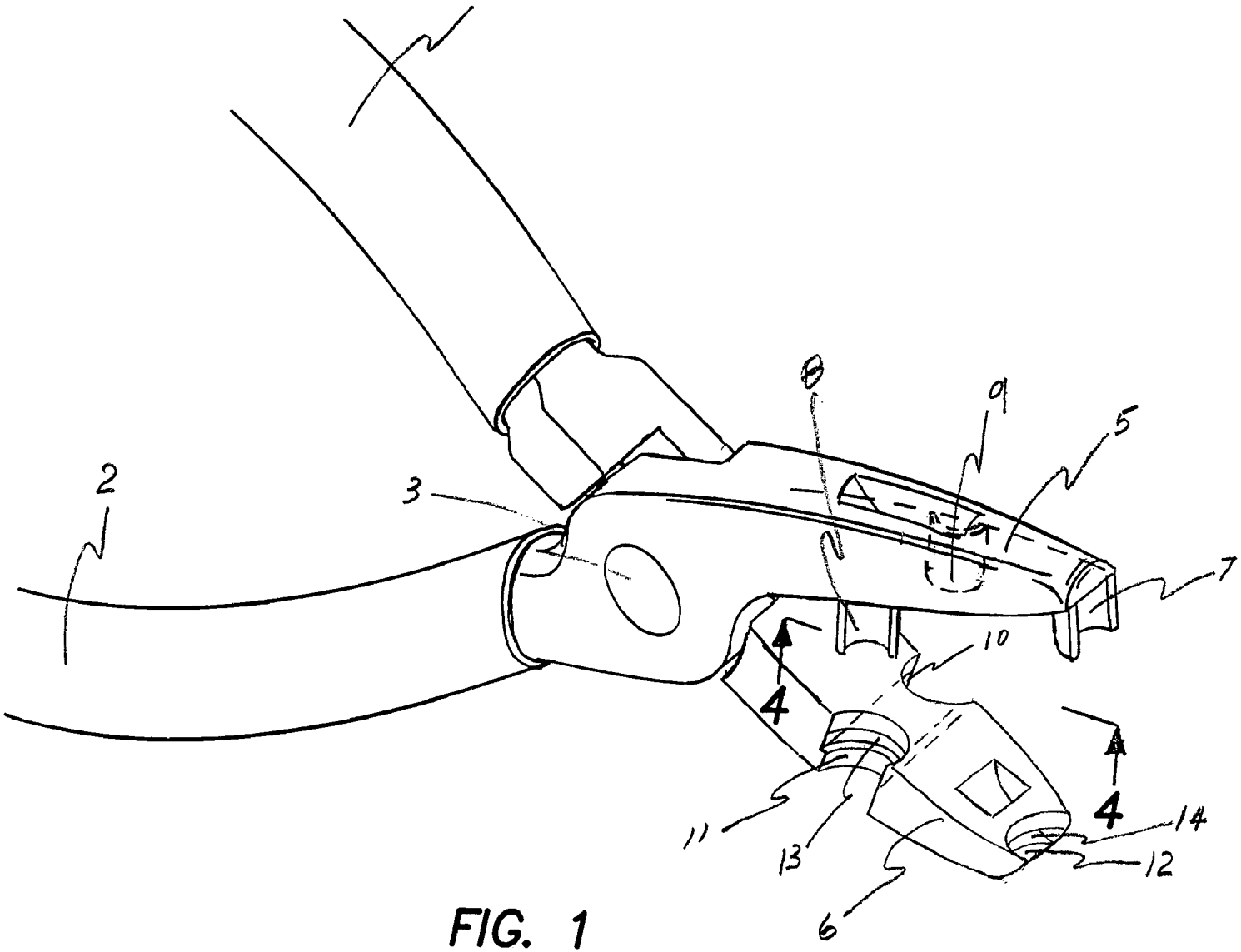
FIGS. 1 though 6 illustrate an embodiment.
Figure 2:
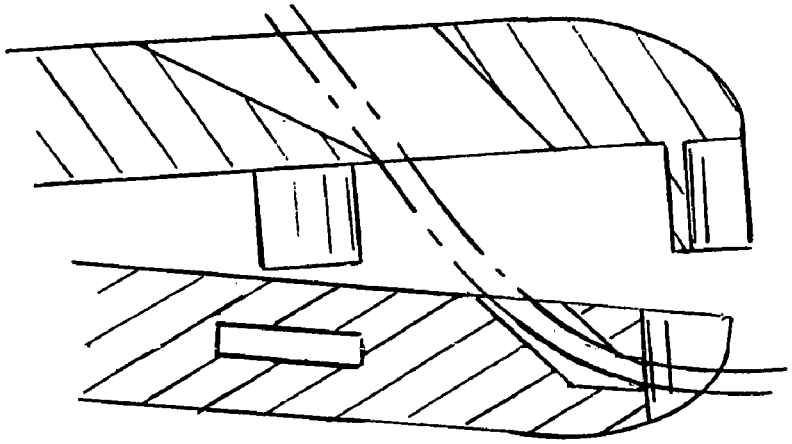
FIG. 2 is a cross section through the jaws of the tool showing the guides in the jaws, and how the tie is guided through the nose of the tool when the jaws are open
Figure 3:
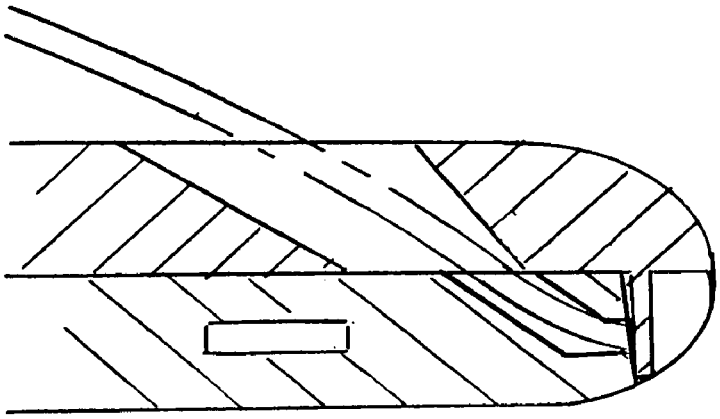
FIG. 3 is a cross section through the jaws of the tool when the jaws are closed and showing the cut tie through the nose.
Figure 4:
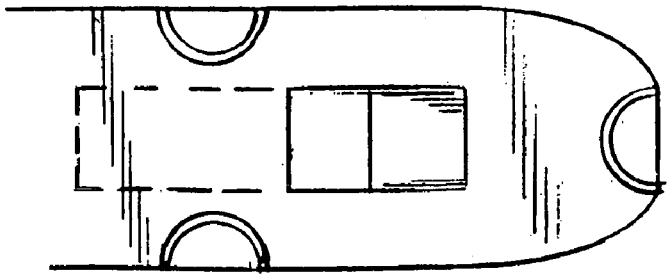
FIG. 4 is a view of the upper jaw as viewed along line 44 in FIG. 1. This view shows the slotted guide and the cutting edges in the upper jaw.
Figure 5:
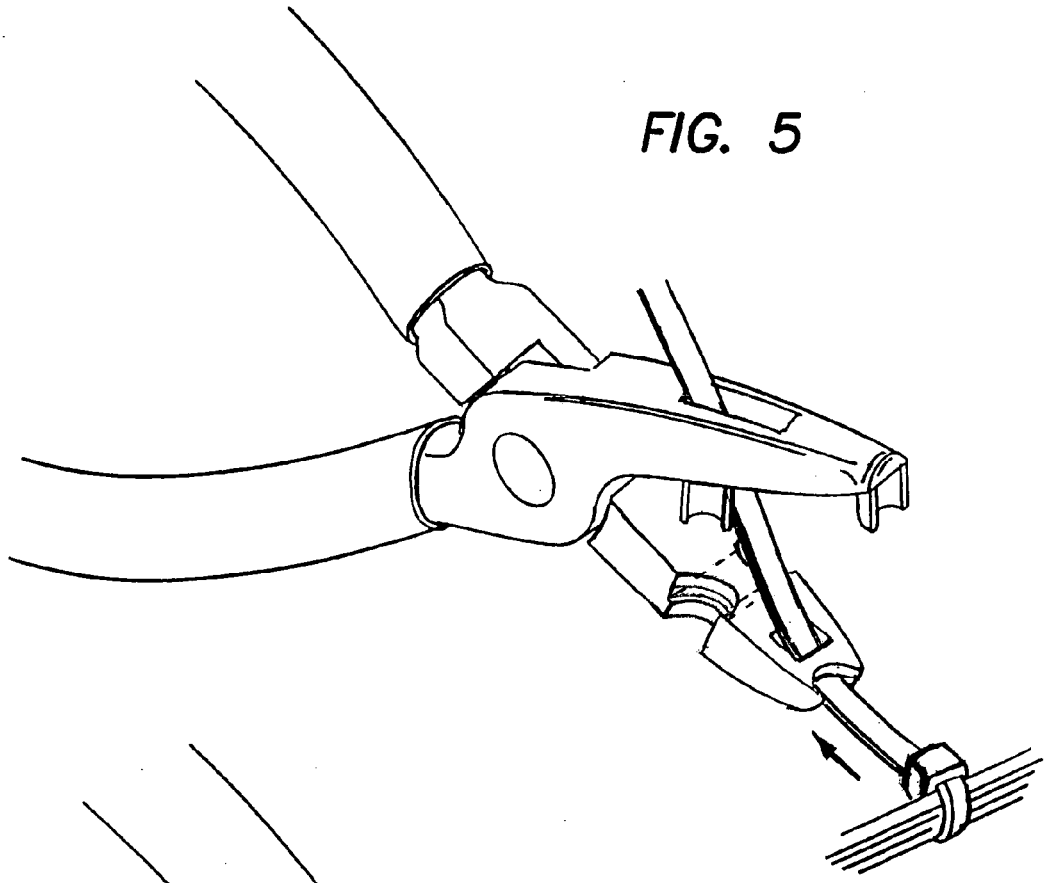
FIG. 5 is an isometric view of the tool showing how a cable tie securing a number of wires is inserted through the nose of the tool.
Figure 6:
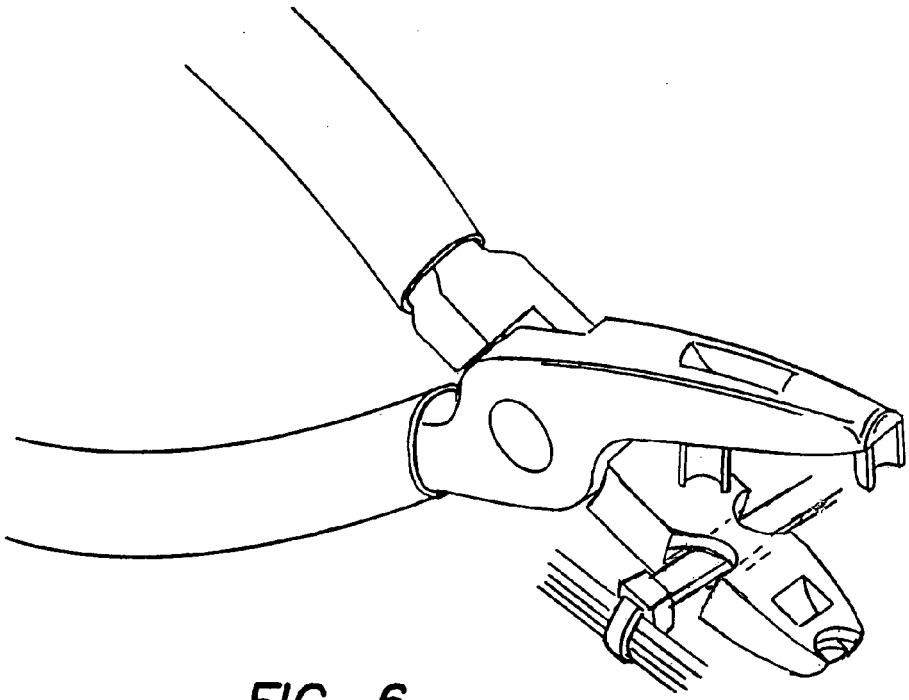
FIG. 6 is an isometric view of the tool showing how a cable tie securing a number of wires is inserted through the guide from the side of the tool.

A preferred embodiment of the present invention is a pliers type tool with curved cutting edges located on the jaws of the tool and with grooved guides in the jaws to insure the proper location of the cable tie in relation to the cutting edges. The curved cutting edges can be semi-circular, less than semi-circular, parabolic, and the like as long as the desired rounded cut on the end of the tie is achieved. This tool is illustrated in the drawings by FIG. 1. When the handles 1 and 2 are squeezed together they pivot around pivot 3 and close jaws 5 and 6. When the jaws close the three rounded cutting edges 7,8 and 9 in the upper jaws are designed to pass through, with very close tolerance, the rounded cutting edges 10,11, and 12 in the lower jaws that are below the grooved guides 13 and 14. When the cutting edges on the upper jaws pass through the cutting edges in the lower jaw a cable tie that has been inserted into the grooved guide will be cut leaving a round end on the cable tie.

I claim:

1. A hand tool for cutting a strap that leaves a smooth rounded end on the cut strap, the tool comprising:

two handles which are connected together in a single plane at a pivot point by means of a pivot connector;

upper and lower mating cutting jaws carried by said handles; wherein each said cutting jaw includes a forward end; wherein the upper jaw has three downwardly protruding curved cutting edges and the lower jaw has three corresponding curved cutting edges so located that when said cutting jaws are urged towards each other by said handles the curved cutting edges in the upper jaw pass into the curved cutting edges in the lower jaw;

wherein one of said cutting edges in said upper jaw is located at the forward end of said upper jaw and one of said cutting edges in said lower jaw is located at the forward end of said lower jaw; wherein said lower cutting jaw also includes a slot extending through said forward end thereof; wherein said upper cutting jaw also includes a slot extending vertically therethrough; wherein said slots are so located that a strap can be guided into the tool through said slots and secured in a position to insure the desired cut on the strap by said cutting edges at said forward ends of said upper and lower jaws.

2. A hand tool for cutting a strap that leaves a smooth rounded end on the cut strap, the tool comprising:

two handles which are connected together in a single plane at a pivot point by means of a pivot connector;

upper and lower mating cutting jaws carried by said handles; wherein the upper jaw has two or more curved cutting edges and the lower jaw has two or more curved cutting edges so located that when said cutting jaws are urged towards each other by said handles the cutting edges in the upper jaw pass into the curved cutting edges in the lower jaw;

wherein said lower cutting jaw also includes a slot extending through said jaw so located as to extend between said two curved cutting edges in said lower cutting jaw such that a strap can be guided through the slot and secured in a position perpendicular to the lower cutting jaw to insure the desired cut on the strap.

* * * * *